US008079671B2

(12) United States Patent
Brown

(10) Patent No.: US 8,079,671 B2
(45) Date of Patent: Dec. 20, 2011

(54) COATED ELECTRODES FOR A DROP-ON-DEMAND PRINTER

(75) Inventor: Peter James Brown, Cambridgeshire (GB)

(73) Assignee: Tonejet Limited, Melbourn, Royston, Hertfordshire (GB)

( * ) Notice: Subject to any disclaimer, the term of this patent is extended or adjusted under 35 U.S.C. 154(b) by 462 days.

(21) Appl. No.: 12/065,740

(22) PCT Filed: Aug. 17, 2006

(86) PCT No.: PCT/GB2006/050243

§ 371 (c)(1), (2), (4) Date: Mar. 5, 2008

(87) PCT Pub. No.: WO2007/039762

PCT Pub. Date: Apr. 12, 2007

(65) Prior Publication Data

US 2008/0246816 A1 Oct. 9, 2008

(30) Foreign Application Priority Data

Oct. 4, 2005 (GB) ..... 0520159.5

(51) Int. Cl.
*B41J 2/06* (2006.01)

(52) U.S. Cl. ..... 347/55

(58) Field of Classification Search ..... 347/55
See application file for complete search history.

(56) References Cited

U.S. PATENT DOCUMENTS

| | | | | |
|---|---|---|---|---|
| 5,340,499 | A * | 8/1994 | Karna et al. | 252/500 |
| 6,099,757 | A * | 8/2000 | Kulkarni | 252/500 |
| 6,247,797 | B1 * | 6/2001 | Newcombe et al. | 347/55 |
| 2003/0015691 | A1 * | 1/2003 | Haghighat et al. | 252/500 |

FOREIGN PATENT DOCUMENTS

| | | |
|---|---|---|
| EP | 0813965 | 6/1997 |
| EP | 1225048 | 7/2002 |
| WO | WO 97/27056 | 7/1997 |

* cited by examiner

*Primary Examiner* — Omar Rojas

(57) ABSTRACT

A drop on demand printer is provided having: an ink ejection location for ejecting ink droplets, the ejection location having an associated ejection electrode for causing electrostatic ejection of the droplets from the ejection location; an intermediate electrode spaced from the ejection location, and in use disposed between the ejection location and a substrate onto which the droplets are printed in use; wherein either the ejection electrode or the intermediate electrode is coated with a film, the film being formed from a blend of a polymer insulating host and a conducting polymer dopant.

8 Claims, 2 Drawing Sheets

COATED ELECTRODES FOR A DROP-ON-DEMAND PRINTER

BACKGROUND OF THE INVENTION

The present invention relates to electrodes for a drop-on demand printer of the type described in WO-A-9311866 and, more particularly in WO-A-9727056, in which an agglomeration or concentration of particles is achieved at an ejection location and, from the ejection location, particles are then ejected onto a substrate for printing purposes. The present invention relates to controlling the resistance of electrodes in the printer in order to prevent electrostatic discharge.

In WO-A-9727056 we describe an apparatus which includes a plurality of ejection locations disposed in a linear array, each ejection location having a corresponding ejection electrode so that the ejection electrodes are disposed in a row defining a plane. One or more secondary (intermediate) electrodes are disposed transverse to the plane of the ejection electrodes in front of the ejection locations so that the sensitivity of the apparatus to influence by external electric fields can be reduced. The sensitivity to variations in the distance between the ejection location and the substrate on to which the particles are ejected is also reduced. The secondary electrode is preferably disposed between the ejection electrodes and the substrate and may comprise a planar electrode containing a central slit through which particles are ejected on to the substrate or plural secondary electrodes.

Electrostatic discharge may occur between the ejection electrodes and the intermediate electrodes, causing misprinting.

In WO 02/05708 we describe how electrostatic breakdown can be prevented by including a resistive element adjacent to an intermediate electrode, on a conductive track which supplies a voltage to the intermediate electrode.

As an alternative to the use of a resistive element adjacent to an intermediate electrode, electrostatic discharge can be prevented by coating the intermediate electrode surface with an insulator. In practice, however, if the resistance of the coating is too large then the surface of the insulator on the electrode charges up due to the build up of leakage current between the electrodes or the electrostatic attraction of naturally occurring charged particles, such as dust. As this charge builds up it opposes the applied field, reducing its strength and therefore compromising the operation of the system that requires a high electric field. It is conceivable that this charging rate may vary over several orders of magnitude (depending on the exact nature of the system) therefore one needs to be able to tune the resistance of the film in order to achieve the correct balance between the protective nature of the coating whilst ensuring that charge does not build up on the surface of the coating. This could be achieved by controlling the thickness of the coating; however, because most insulators have a bulk resistivity of approximately $10^{14}$-$10^{15}$ Ωm the film would have to be impractically thin to achieve the desired resistance using a standard insulator. Thus, in order to be able to achieve the required resistance using a practical film thickness that can be produced as a defect free film, it is necessary to find a material with a resistivity that is lower than this, and which can be tuned to eliminate the effect of the charging mechanisms.

Unfortunately, very few naturally occurring materials exhibit a resistivity in the required range of $10^{2}$-$10^{14}$ Ωm. Elemental metals have a resistivity of approximately $10^{-6}$-$10^{-7}$ Ωm and insulators have a resistivity of greater than approximately $10^{13}$ Ωm. Semiconductors have resistivities that are dependent on temperature and doping density, to name but two variables, but in this case it is impractical to consider using these variables as a method of tuning the resistivity.

An aim of the present invention is to reduce the likelihood of electrical breakdown and electrostatic discharge between the electrodes.

SUMMARY OF THE INVENTION

According to the present invention there is provided a drop on demand printer having:

an ink ejection location for ejecting ink droplets, the ejection location having an associated ejection electrode for causing electrostatic ejection of the droplets from the ejection location;

an intermediate electrode spaced from the ejection location, and in use disposed between the ejection location and a substrate onto which the droplets are printed in use;

wherein either the ejection electrode or the intermediate electrode is coated with a film, the film being formed from a blend of a polymer insulating host and a conducting polymer dopant.

A material with the desired resistivity can be created by forming an electrical percolation network from materials of differing resistivity. Starting with a pure host material (a good insulator for example), the resistivity can be decreased controllably by increasing the doping level of the conducting dopant. As the doping density increases, conducting pathways are created through the insulator and the bulk resistivity drops, eventually reaching that of the conducting dopant. From the point of view of preventing electrostatic discharge, a useful feature of a percolation network is that the resistivity can vary rapidly at low doping densities, whilst the host matrix dominates other bulk or surface properties. Thus, the bulk resistivity can drop several orders of magnitude whilst the surface electron density closely resembles that of the undoped host material.

Preferably the polymer film conducts via a percolation network formed on a molecular scale. The percolation network may be formed on a molecular scale to help prevent electrostatic discharges. By molecular scale it is meant that the nodes of the percolation network are separated by between $10^{-7}$ m to $10^{-10}$ m.

If larger organic or inorganic particles were to be used as the conductive dopant instead of a conductive polymer that can be blended with the resistive host, then the material will have a granulated surface that can locally enhance any applied electric field by over two orders of magnitude. Furthermore, any conducting particles that protrude from the surface act as reservoirs of readily available charge that can act as initiation sites for electrostatic discharge. Both of these mechanisms greatly increase the rate of electrostatic discharges.

The polymer insulating host may be a thermosetting polyimide.

The conducting polymer dopant may be a polymer blend of poly(ethylenedioxythiophene) doped with poly(styrenesulphonate).

The film may be between 10 nm and 50 μm thick. Preferably, the film is between 1 μm and 20 μm thick.

BRIEF DESCRIPTION OF THE DRAWINGS

One example of the present invention will now be described with reference to the accompanying drawings, in which.

DESCRIPTION OF THE INVENTION

Figure 1:
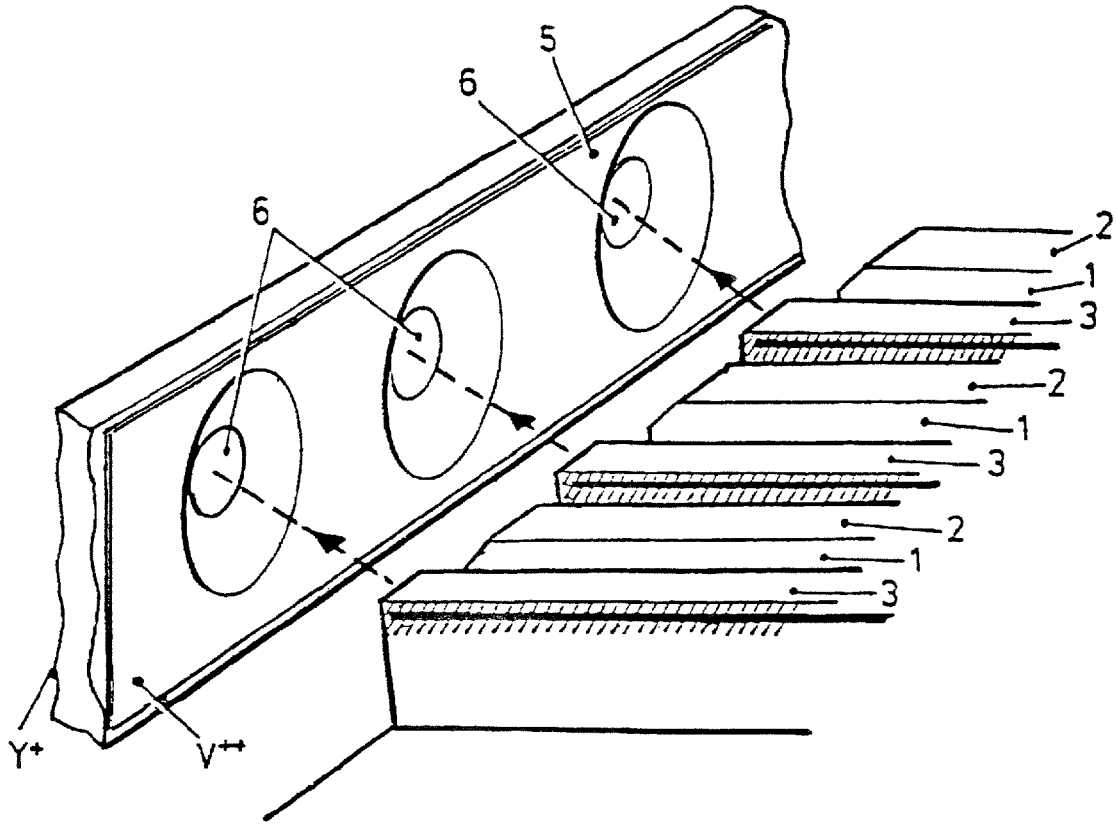
FIG. 1 illustrates part of a printhead having a row of ejection cells and corresponding intermediate electrodes.
Figure 2:
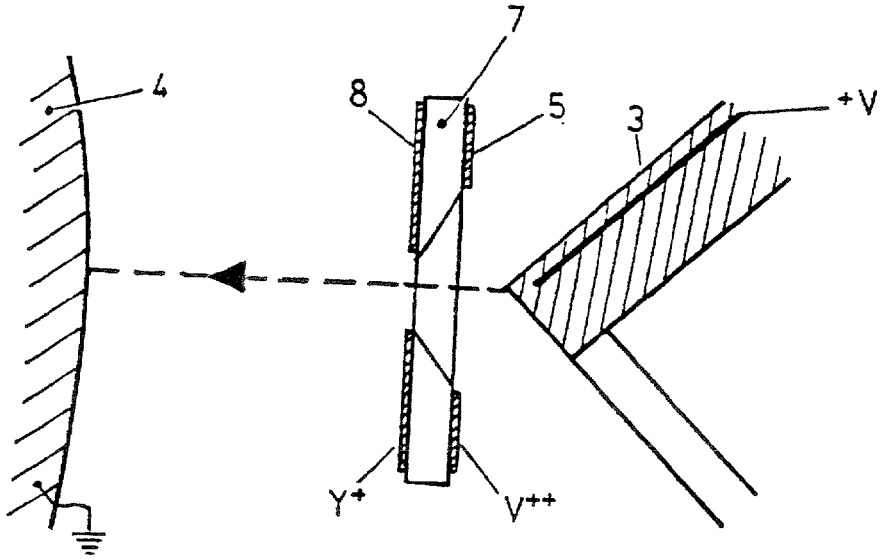
FIG. 2 illustrates the arrangement of FIG. 1 in side view.

FIGS. 1 & 2 illustrate a printhead, diagrammatically, the printhead having plural cells 1 separated by insulating walls 2 and each containing an ejection electrode 3. As described in WO-A-9727056, agglomerations of particles carried by fluid in each of the cells can be ejected from the cells on application of a voltage to the respective electrodes 3 as indicated by the arrows in FIG. 1. FIG. 2 shows a substrate 4 onto which agglomerations of particles, for printing, are ejected from the cells 1. In order to reduce the sensitivity of the head to variations in the distance between the cells and the substrate 4, an intermediate electrode 5, which has plural apertures 6 disposed opposite respective cells 1, is provided in front of the ejection cell. As shown the electrode 5 is disposed on a first side of a support 7 and a further intermediate electrode 8 is disposed on the other side. Charged agglomerations of particles emitted from the cell 1 pass through the electrodes 5 and 8 onto the earthed substrate 4.

In one method, for example, the voltages applied to the electrodes may be 1 kV on the ejection electrodes 3 for ejection purposes, 500V on the intermediate electrode 5 and 0V on the further intermediate electrode 8. The electrode support 7 may be provided by 150 micron thick glass slips chrome plated on both faces to provide the electrodes 5,8, and with the apertures 6 formed with 45 degree chamfered faces and having a width of 50 microns. The intermediate electrode 8 may be separated from the outermost extremity of the ejection cells 1 by a distance of 200 microns.

There may, in an alternative embodiment, be plural intermediate electrodes, for example formed in a manner similar to that of FIGS. 1 & 2, but with the intermediate electrodes separately formed, each around a respective aperture 6. Of course, a different configuration altogether may be provided if suitable for a given application.

Problems can arise in that electrostatic discharges may occur between the ejection electrodes and the intermediate electrodes. Electrostatic discharges can occur when the ejection electrodes and the intermediate electrodes are placed in close proximity, generating a large electric field. Field strengths greater than approximately 10 MV/m can initiate discharges by 'pulling' electrons from the surface of the cathode via the quantum-mechanical effect of field emission.

One approach that can be taken to raise the electric field threshold for initiating electrostatic discharges is to increase the work functions of the cathode electrode. Increasing the work function of the cathode increases the energy barrier that confines the electrons; the rate of field emission is exponentially proportional to the inverse of the barrier height.

Figure 3:
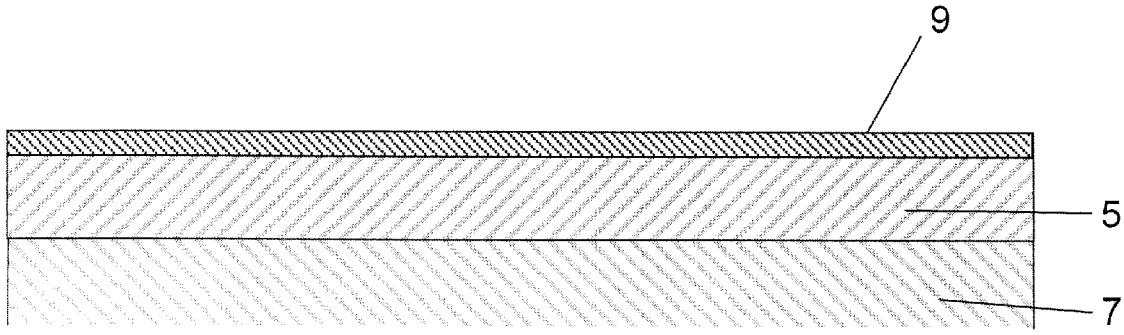
FIG. 3 illustrates the film formed on an intermediate elctrode.

In order to increase the work function of the electrodes and hence reduce the rate of field emission, the electrodes are coated with a film 9, shown in FIG. 3, which has a resistivity tunable to the required level, the film being formed by doping a polymeric insulator with a conducting polymer. The tunable resistivity means that the resistivity can be chosen during manufacture of the film. The film 9 is formed with a thickness of approximately 5 μm to 20 μm.

The lower limit on the thickness range of the film 9 is partly determined by the surface roughness of the support 7 and the electrodes 5, 8. The film 9 must be sufficiently thick so that the electrodes are not exposed through the film. In fact, a smooth substrate and electrode would allow the thickness of the film to be reduced to 1 μm or less.

One process for creating the film is as follows:

A thermosetting polyimide (PI) called Pyralin® PI 2579B from HD Microsystems (an enterprise of Hitachi Chemical and DuPont Electronoics) is used as the insulating polymeric host. This is supplied in precursor form, dissolved in the organic solvent 1-methyl, n-pyrrolidone (NMP) and has a low viscosity of approximately 50-75 cP which means that it can be deposited onto a substrate using solution-processable methods such as spin-coating or drop-casting. Upon curing it forms a hard yellow/brown film with a resistivity of approximately $10^{14}$ Ωm.

A polymer blend poly(ethylenedioxythiophene) doped with poly(styrenesulphonate) (PEDOT/PSS or PEDOT for short) is used as the conducting dopant. This is obtained from Aldrich Chemical Company, catalogue number 48,309-5. This polymer is conventionally used as the hole-injecting electrode in organic LEDs and can have conductivites up to approximately $10^4$ S/cm, depending on the exact composition. Unusually for a (semi)conducting polymer, PEDOT is supplied dissolved in water and is stable in air.

Although water and organic solvents are usually immiscible, water is 25% miscible in NMP allowing the two polymers to be blended in solution. Should a higher doping level of PEDOT be required than provided for by the concentrations of the neat solutions, extra NMP can be added to dilute the PI. The blend remains stable at room temperature, but tends to spontaneously phase separate at temperatures greater than around 40° C. This means that the film must be dried under vacuum at room temperature before curing; the vacuum drying must be performed sufficiently slowly that the water does not boil off and blister the film. Once dry, the curing process can be completed as for pure PI.

It is possible to tune the resistivity over a range of about 10 orders of magnitude. This means the material can have resistive, anti-static, dissipative, or conductive properties, as desired.

The resulting percolation network has excellent material properties due to the polymer composition such as flexibility, abrasion resistance (especially for the PI described above), thermal stability, chemical stability and processability. These properties could be tuned further depending on the required application by selecting other materials for the blend.

Due to the molecular nature of the material, the surface roughness is on a scale of approximately 10 nm. This was achieved by drop-casting films, but a surface roughness on the scale of approximately 1 nm or better could be achieved via spin-coating.

The film can be applied by spin coating, screen printing, dip coating, doctor blade or by any other suitable method.

In an alternative embodiment, a photo-imageable PI could be used as the insulating matrix. This would allow intricate patterns of variable-resistance material to be deposited using lithographic techniques and could allow patterning on a scale that is inaccessible by ordinary printing techniques.

The invention claimed is:

1. A drop on demand printer having:

an ink ejection location for ejecting ink droplets, the ejection location having an associated conductive ejection electrode for causing electrostatic ejection of the droplets from the ejection location;

an intermediate conductive electrode spaced from the ejection location, and in use disposed between the ejection location and a substrate onto which the droplets are printed in use;

wherein either the ejection electrode or the intermediate electrode is coated with a film having a resistivity in a range of between about $10^2$ and about $10^{14}$ Ωm in order to prevent electrical discharge between the ejection electrode and the intermediate electrode, the film being formed from a blend of a polymer insulating host and a conducting polymer dopant.

2. A drop on demand printer according to claim 1, wherein the polymer film conducts via a peroclation network formed on a molecular scale.

3. A drop on demand printer according to claim 1, wherein the polymer insulating host is a thermosetting polyimide.

4. A drop on demand printer according to claim 1, wherein the conducting polymer dopant is a polymer blend poly(ethylenedioxythiophene) doped with poly(styrenesulphonate).

5. A drop on demand printer according to claim 1, wherein the film is between 10 nm and 50 μm thick.

6. A drop on demand printer according to claim 5, wherein the film is between 1 μm and 20 μm thick.

7. A drop on demand printer according to claim 5 wherein the film is between 5 μm and 20 μm thick.

8. A drop on demand printer having:

an ink ejection location for ejecting ink droplets, the ejection location having an associated ejection electrode for causing electrostatic ejection of the droplets from the ejection location;

an intermediate electrode spaced from the ejection location, and in use disposed between the ejection location and a substrate onto which the droplets are printed in use;

wherein either the ejection electrode or the intermediate electrode is coated with a film, the film being formed from a blend of a polymer insulating host and a conducting polymer dopant, and wherein the conducting polymer dopant is a polymer blend poly(ethylenedioxythiophene) doped with poly(styrenesulphonate).

* * * * *